US011304490B2

(12) United States Patent
Screnci et al.

(10) Patent No.: US 11,304,490 B2
(45) Date of Patent: Apr. 19, 2022

(54) SHAVING BRUSH DEVICE AND SYSTEM FOR HOLDING AND HEATING A SHAVE CREAM CANNISTER AND DISPENSING SHAVE CREAM THEREFROM

(71) Applicants: Ralph Screnci, Fort Lauderdale, FL (US); David A. Killam, San Francisco, CA (US)

(72) Inventors: Ralph Screnci, Fort Lauderdale, FL (US); David A. Killam, San Francisco, CA (US)

( * ) Notice: Subject to any disclaimer, the term of this patent is extended or adjusted under 35 U.S.C. 154(b) by 0 days.

(21) Appl. No.: 17/071,502

(22) Filed: Oct. 15, 2020

(65) Prior Publication Data

US 2021/0106114 A1 Apr. 15, 2021

Related U.S. Application Data

(60) Provisional application No. 62/915,398, filed on Oct. 15, 2019.

(51) Int. Cl.
*A45D 27/04* (2006.01)
*A45D 40/00* (2006.01)

(52) U.S. Cl.
CPC ..... *A45D 27/04* (2013.01); *A45D 40/0081* (2013.01); *A45D 2200/109* (2013.01); *A45D 2200/155* (2013.01); *A46B 2200/1033* (2013.01)

(58) Field of Classification Search
CPC ..... A45D 2200/109; A45D 2200/1033; A45D 27/04; A45D 27/06; A45D 27/10;
(Continued)

(56) References Cited

U.S. PATENT DOCUMENTS 1,813,616 A * 7/1931 Frazier ..... A46B 11/08 401/1
2,955,191 A * 10/1960 Galgano ..... B65D 83/72 219/436
(Continued)

FOREIGN PATENT DOCUMENTS

WO WO 2008099343 * 2/2008
WO 2012067845 5/2012
WO 2017064104 4/2017

OTHER PUBLICATIONS

International Search Authority, International Search Report and Written Opinion for PCT/US2020/055821, dated Jan. 14, 2021, pp. 1-12.

*Primary Examiner* — Yogesh P Patel
*Assistant Examiner* — Jennifer Gill
(74) *Attorney, Agent, or Firm* — The Concept Law Group, PA; Scott D. Smiley; Scott M. Garrett

(57) ABSTRACT

A shaving cream dispenser and application device include a handle having an upper portion and a lower portion which form an internal cavity in which a travel sized shaving cream aerosol canister is placed. The canister includes a nozzle stem on the top that, when pressed towards the canister, opens an internal valve in the canister to release the shaving cream through the nozzle stem. The upper and lower portions of the handle are movably retained together, and a channel is provided at the top of the handle through which the shaving cream is dispensed into a brush or set of bristles at the top of the handle. The nozzle stem is actuated by pressing or moving the upper portion of the handle towards the lower portion. The lower portion of the handle further includes a heating element to heat the canister so that heated shaving cream can be dispensed. A stand is configured to hold the lower portion of the handle and provide electric
(Continued)

power to the heating element in the lower portion of the handle.

18 Claims, 6 Drawing Sheets

(58) Field of Classification Search
CPC .. A45D 27/29; A45D 34/042; A45D 40/0081; A45D 2200/155; B65D 83/20; B65D 83/207; B65D 83/203; B65D 83/205; B65D 83/384; B65D 83/285; B65D 83/72; A46B 11/08; A46B 11/0017; A46B 2200/1033
USPC ..... 222/146.3
See application file for complete search history.

(56) References Cited

U.S. PATENT DOCUMENTS 3,093,857 A * 6/1963 Hersh ..... B65D 83/285 401/190
3,116,403 A * 12/1963 Alvab ..... B65D 83/285 219/214
3,387,911 A * 6/1968 Focht ..... B65D 83/205 401/190
3,388,958 A * 6/1968 Johnson ..... A46B 11/0017 401/2
3,454,745 A 7/1969 Stone
3,495,922 A 2/1970 Steinman
3,498,504 A * 3/1970 Wilkins ..... F24H 1/00 222/146.3
3,896,973 A 7/1975 Morgan
4,248,543 A 2/1981 Carrington
4,959,528 A * 9/1990 Malloy ..... B60N 3/103 219/202
5,692,846 A * 12/1997 Schwarzberg ..... A47L 23/05 401/190
5,700,991 A 12/1997 Osbern
5,786,573 A 7/1998 Fabrikant et al.
6,003,523 A 12/1999 Nettlefold
6,056,160 A 5/2000 Carlucci et al.
7,066,674 B2 * 6/2006 Gueret ..... A45D 34/04 401/125
7,695,207 B1 4/2010 Laghi
8,550,739 B1 10/2013 Robbins
8,794,249 B2 * 8/2014 Gerber ..... A45D 27/04 132/290
9,801,460 B2 * 10/2017 Lim ..... A46B 17/04
9,826,823 B1 * 11/2017 Velazquez ..... A45D 27/04
2011/0142530 A1 6/2011 Myers
2012/0246856 A1 10/2012 Screnci, Jr. et al.
2013/0118515 A1 5/2013 Wurtz et al.
2020/0390221 A1 * 12/2020 Di Mella ..... A45D 40/262

* cited by examiner

SHAVING BRUSH DEVICE AND SYSTEM FOR HOLDING AND HEATING A SHAVE CREAM CANNISTER AND DISPENSING SHAVE CREAM THEREFROM

CROSS REFERENCE

This application claims the benefit of U.S. provisional application No. 62/915,398 filed Oct. 15, 2019, the entirety of which is hereby incorporated by reference.

FIELD OF THE INVENTION

The present invention relates generally to shaving brushes, and more particularly to a shaving brush having a handle that contains a heating element in which a shave cream aerosol canister is provided to dispense shave cream through the brush, with or without a removable brush head, and a base on which the shaving brush stands that includes a heating element.

BACKGROUND OF THE INVENTION

It has long been known that heat is beneficial in the shaving process. Heat helps open pores and soften the hairs/whiskers, allowing more of the hair to be cut without nicks. The conventional method of employing heat in the shaving process is to use hot or very warm water on the face, as well as to dissolve a shaving soap with a shaving brush to create a froth that is applied with the brush. A brush allows a person to better distribute the material on the face than can be done using just the hands, and doesn't require the person to wash their hands of excess soap/cream before holding the razor to commence shaving. Therefore, it is desirable to have heated shaving cream and a brush to apply heated shaving cream.

Today many people use shaving cream that is provided in aerosol cans or containers for their convenience and there are a great many different sized canisters available in the market. Some manufacturers have developed devices for heating shaving cream dispensed from such canisters, as well as other dispensing devices that use a more proprietary arrangement such as cartridges. Some devices heat the whole can or apply heat to a portion of the can, while others heat only the cream being dispensed. Can heaters are generally designed for a standard size shaving cream can. In addition, there are clip-on type brush dispensers that can be used to brush on shave cream, but the can size can be awkward for using as a brush handle. Other devices using proprietary sized cartridges may be appropriately sized, but the cartridges can be expensive or difficult for consumers to acquire. Further, conventional heating devices typically leave some heated surfaces exposed, such as either the can, the heating element in the heating device, or both, which can cause an undesired burn or other harm.

Therefore, a need exists to overcome the problems with the prior art as discussed above.

SUMMARY OF THE EMBODIMENTS

The invention provides a heated shave cream dispenser that overcomes the hereinafore-mentioned disadvantages of the heretofore-known devices and methods of this general type and that allows a user to heat and dispense shaving cream into a brush for ready application to a user's face.

In accordance with some embodiments of the inventive disclosure, there is provided a shaving cream heating and dispensing device that includes an upper portion and a lower portion that are configured to hold a shaving cream aerosol canister therein. Wherein the canister defines a vertical axis. The lower portion includes a heat conductive cup that is configured to receive a lower portion of the canister therein in thermal contact with the canister. There is further included a heating element configured to heat the cup, and at least one retention member configured to interface with a retention feature of the upper portion that allows the lower portion to move along the vertical axis. The upper portion includes a brush at a top end of the upper portion, a channel formed through the top end to an interior of the top end and having a shoulder at the interior sized to receive a nozzle stem of the canister. Either compressing the lower portion and upper portion together or pressing an activator at the base of the lower portion engages the nozzle, thereby causing shaving cream to be dispensed from the canister, through the channel, and into the brush.

In accordance with a further feature, the device further includes a stand having a receiving cup feature having a space sized to receive the lower portion, and electrical contacts disposed in the receiving cup that are configured to mate with corresponding electrical contacts on the lower portion.

In accordance with a further feature, the device can further include an alignment feature disposed in the receiving cup that corresponds with an alignment feature on the lower portion and which prevents the lower portion from being fully seated in the receiving cup unless the alignment features are aligned.

In accordance with a further feature, the stand further includes an electrical connector configured to connect to an external electric power source, and a switch circuit including a button switch on an external portion of the stand that, when the button switch is activated, provided electric power to the heating element through the electrical contacts.

In accordance with a further feature, the heating element is configured to remain on while the shaving cream aerosol canister is present in the handle.

In accordance with a further feature, the canister is a travel-sized canister.

In accordance with a further feature, the brush is provided on a replaceable brush unit that can be removed from the top end of the upper portion.

In accordance with other embodiment of the inventive disclosure, there is provided a shaving cream heating and dispensing system that includes a handle configured to hold a shaving cream aerosol canister in a cavity therein, the handle having a top portion, a brush including a set of bristles located on a top of the top portion of the handle in a collar, and a channel formed through the collar. The channel having a shoulder for engaging a nozzle stem of the shaving cream aerosol canister, wherein shaving cream in the shaving cream aerosol canister is dispensed through the channel into the set of bristles upon moving top portion axially with respect to the shaving cream aerosol canister. The system further includes a heating element configured to heat the shaving cream aerosol canister when the shaving cream aerosol canister is inside the bore of the handle.

In accordance with a further feature, the brush can be a replaceable brush unit.

In accordance with a further feature, the channel in the replaceable brush unit includes a conic opening at a bottom of the channel.

In accordance with a further feature, the heating element is configured to remain on while the shaving cream aerosol canister is present in the handle.

In accordance with a further feature, element is configured to operate in response to a manual actuation of a button or other actuator on the handle.

In accordance with a further feature, the handle further comprises a lower portion having a cavity corresponding to the cavity of the upper portion, wherein a lower portion of the shaving cream aerosol canister is disposed in the cavity of the lower portion of the housing when the shaving cream aerosol canister is in the handle.

In accordance with a further feature, the replaceable brush unit comprises a lower portion of the replaceable brush unit that fits into a top opening of the upper portion of the handle and includes a retaining feature that engages a corresponding retaining feature of the handle to retain the replaceable brush unit on the top of the handle.

In accordance with a further feature, the retaining feature on the lower portion of the replaceable brush unit includes a detent protrusion.

In accordance with a further feature, the top portion of the handle, at an inside of the top opening of the top portion of the handle, includes a first lip and a second lip with a channel formed between them that is sized to allow the detent protrusion to pass upon inserting the replaceable brush unit into the top opening of the handle, and wherein the second lip extends farther down than the first lip and prevents the detent protrusion from passing in a direction of the second lip, and wherein the first lip is sized to allow the detent protrusion to pass under it upon the replaceable brush unit being rotated such that the detent protrusion moves in a direction of the first lip from the channel between the first and second lips.

In accordance with other embodiments of the inventive disclosure, there is provided a shaving cream heating and dispensing device that includes a handle including an upper portion and a lower portion that each include a cylindrical cavity sized to hold a shaving cream aerosol canister therein. The shaving cream aerosol canister defines a vertical axis, and the upper portion includes a brush at a top end of the upper portion. A channel is formed from a top of the cylindrical cavity to a set of bristles of the brush. The channel includes a shoulder that is positioned and sized to bear against a top if a nozzle stem of the shaving cream aerosol canister therein. The lower portion of the handle includes a heat conductive cup surrounding the cylindrical cavity that is configured to receive a lower portion of the shaving cream aerosol canister therein in thermal contact with the shaving cream aerosol canister. The lower portion also includes a heating element configured to heat the cup and a control circuit to control operation of the heating element. The lower portion further includes at least one retention member at a top of the lower portion of the handle that is configured to interface with a retention feature at a bottom of the upper portion of the handle that allows the lower portion of the handle to move along the vertical axis relative to the upper portion of the handle. The nozzle stem of the shave cream aerosol canister biases the top portion of the handle away from the lower portion of the handle as a result of the nozzle stem of the shave cream aerosol canister bearing against the shoulder in the channel, and a bottom of the shave cream aerosol canister bearing against a bottom of the heat conductive cup, and wherein the upper and lower portions of the handle are configured to move relative to each other so as to compress the nozzle stem of the shave cream aerosol canister to thereby dispense shave cream through the channel into the brush.

In accordance with a further feature, the lower portion of the handle includes a pair of electrical contacts that electrically interface with corresponding electrical contacts in a stand, wherein the stand is configured to hold the handle in an upright vertical position.

In accordance with a further feature, the lower portion of the handle and the stand include orienting features that require the handle to be in a particular orientation relative to the stand before the electrical contacts of the handle can make contact with the corresponding contacts of the stand.

Although the invention is illustrated and described herein as embodied in a heated shave cream dispenser, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
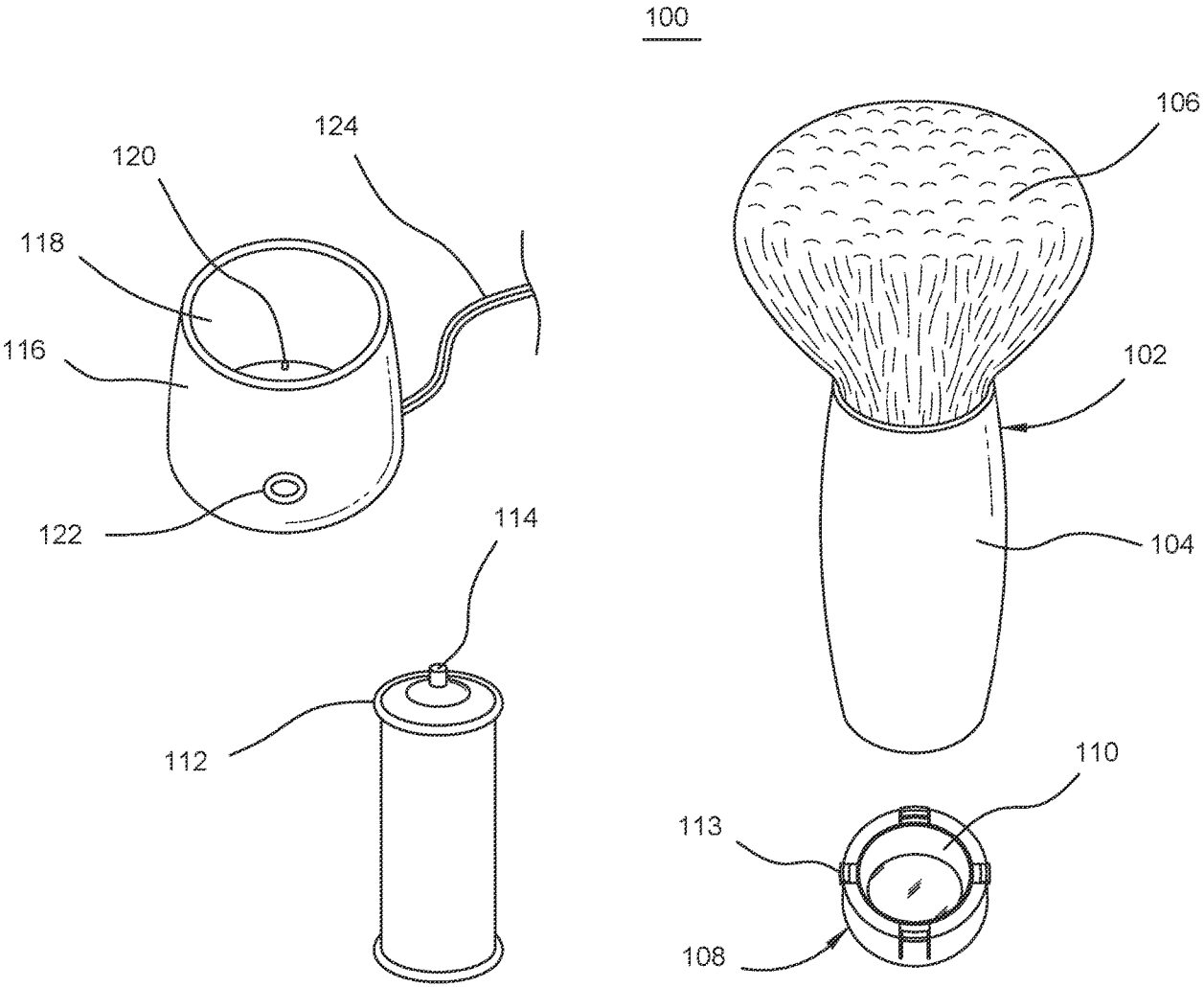
FIG. 1 is an overhead view of a disassembled heated shave cream dispensing system, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention which can be embodied in various forms.

FIG. 1 is an overhead perspective view of a disassembled heated shave cream dispensing system 100, in accordance with some embodiments. The system 100 includes an upper portion 102 and a lower portion 108 of a housing. The upper portion 102 and the lower portion 108 each include a substantially cylindrical cavity that align when the upper and lower portions 102, 108 are assembled together. By "align" it is meant that the respective cavities will be contiguous and coaxial upon the upper portion 102 being assembled to the lower portion 108. The upper and lower portions 102, 108 can be separated as shown in order to insert a travel sized shave cream canister 112 inside the housing, such as by inserting the shave cream canister 112 into the cylindrical cavity of either the upper portion 102 or the lower portion 108, and then, while assembling the upper portion 102 to the lower portion 108, the shave cream canister 112 is then inserted into the cylindrical cavity of the other portion (102 or 108). Accordingly, the upper portion 102 and lower portion 108 can then be assembled together with the travel sized shave cream canister 112 therein. The upper portion 102 includes a sidewall 104 that can be substantially cylindrical and coaxial with the cylindrical cavity in the upper portion, which is large enough to accommodate the travel sized shave cream canister 112 therein. A brush 106 is provided at the top of the upper portion 102, and a channel through the top of the upper portion 102 allows shave cream to be dispensed from the travel sized shave cream canister 112 into the brush 106 so that it can be applied, using the brush 106. The channel is formed from the top of the cylindrical cavity inside the upper portion 102 to the top exterior of the upper portion 102 to allow shave cream to be dispensed from the travel sized shave cream canister 112 into the brush 106.

The lower portion 108 can include a heat conducting cup 110 which forms the cylindrical cavity in the lower portion 108 in which the travel sized shave cream canister 112 sits. The heat conducting cup 110 is sized so as to make sufficient thermal contact with the sides and bottom of the travel sized shave cream canister 112, but the fit is not so tight as to inhibit insertion and removal of the travel sized shave cream canister 112, only to allow heat conduction from the heat conducting cup 110 to the canister 112. The bottom of the heat conducting cup 110 can be contoured (domed) to correspond to the shape of the bottom of the travel sized shave cream canister 112. The lower portion 108 also includes a heating element and associated circuitry to heat the heat conducting cup 110 to transfer heat into the travel sized shave cream canister 112. In other embodiments alternative heating structures can be used, such as, for example, a resistive wrap that surrounds a portion of the side of the canister 112.

The lower portion 108 also includes retention features 113 that engage corresponding retention features or components inside the bottom of the upper portion 102. The retention features are designed to retain the lower portion 108 on the bottom of the upper portion 102, but also to allow movement in the vertical direction (i.e. along the longitudinal axis of the housing). The vertical movement allows the nozzle 114 of the travel sized shave cream canister 112 to actuate a valve inside the canister 112 by features inside the upper portion 102, and the nozzle 114 and valve mechanism act like a spring to bias the lower portion 108 away from the upper portion 102. That is, the nozzle stem 114 of the shave cream canister is biased upward, in a direction away from the canister, by the pressure inside the canister. This pressure is sufficient, in biasing the nozzle closed, to also push against the upper and lower portions, urging them away from each other along the axis of the cavity/canister. The retention features 113 hold the upper and lower portions 102, 108 together, but allows sufficient relative movement between the upper and lower portions 102, 108 such that the nozzle will close absent an outside force acting against the nozzle through the housing portions 102, 108, such as by pushing the upper and lower portions 102, 108 together, towards each other, along the axis of the canister/cavity. The retention features 113 are designed to allow removal of the lower portion 108 from the upper portion 102, as well, so that a new travel sized shave cream canister 112 can be installed, and a depleted one can be removed, if necessary.

A stand 116 includes a cavity 118 that is sized to receive the lower portion 108 therein. The stand 116 is therefore configured to hold the assembled upper and lower portions 102, 108 in an upright position so that the housing can be easily grasped by a person to remove and use the housing as a brush to apply heated shave cream. In the cavity 118 are electrical contacts 120 that mate with corresponding electrical contacts on the bottom of the lower portion 108. Electric power is provided through the electrical contacts 120 to the heat element in the lower portion 108 which heats the heat conducting cup 110 to distribute heat to the travel sized shave cream canister 112. Electric power can be provided through a cord/cable 124, such as a USB cable, or a DC cable from a AC to DC transformer power supply. A button 122 or other activator mechanism can be used to activate a heating cycle by activating a timer control circuit that provides electric power to the lower portion 108 though the electrical contacts (e.g. 120) for a period of time, or until a threshold temperature is reached. A light source such as a light emitting diode can be used to indicate that the power is "on" and then to indicate when the shave cream has been heated to a preselected temperature. In some embodiments the light can be provided through a transparent bezel around, or that is part of the button 122.

Figure 2:
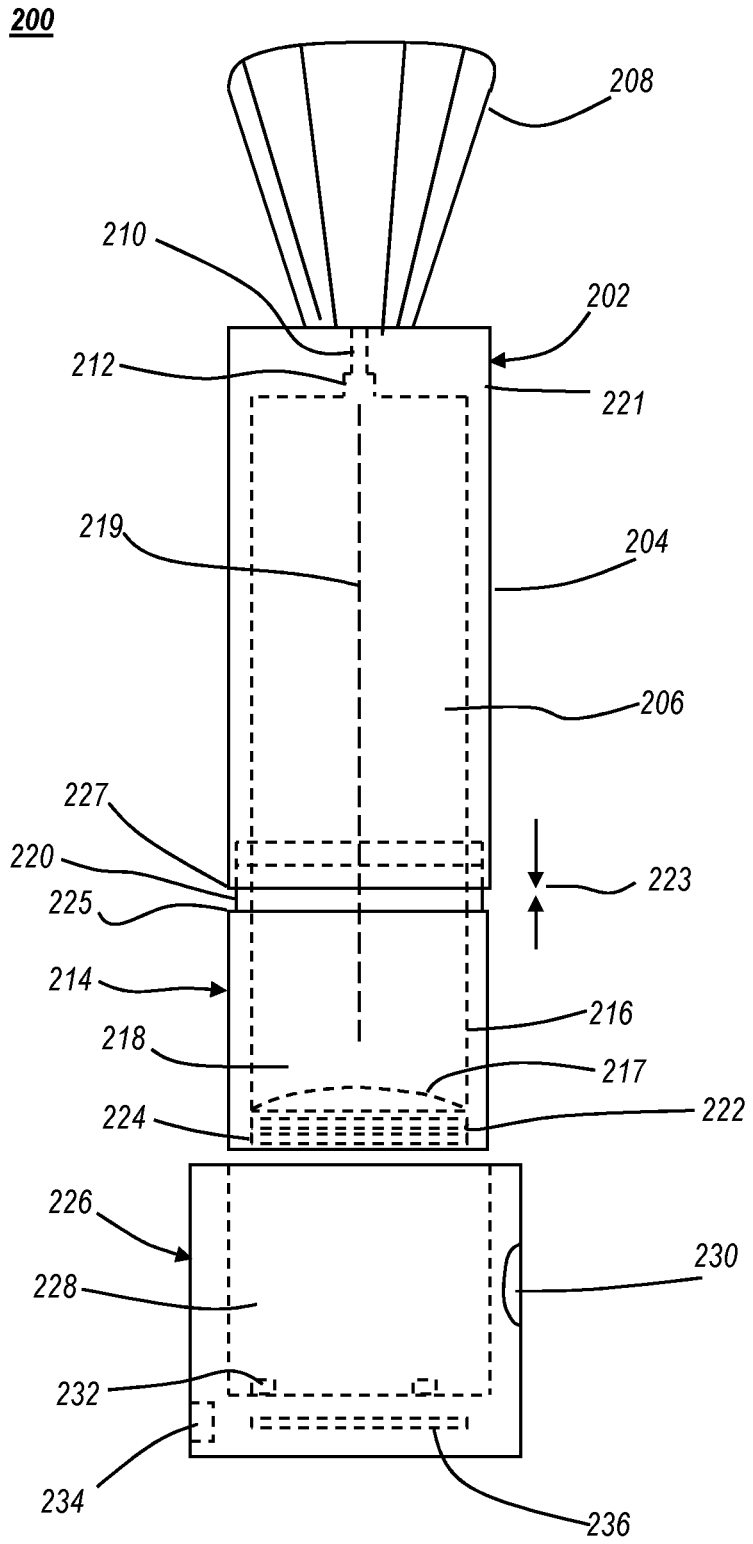
FIG. 2 is a side elevational view of a heated shave cream dispensing system, in accordance with some embodiments.

FIG. 2 is a side elevational view of a heated shave cream dispensing system 200, in accordance with some embodiments. The system 200 shown here is substantially equivalent to that (100) shown in FIG. 1, different reference numerals notwithstanding. A housing is comprised of an upper portion 202 and a lower portion 214, each having cylindrical cavities 206, 218, respectively, that together form a space in which to contain a travel sized shave cream canister (e.g. 112) and are designed to be joined and movably retained together. The cavities are contiguous and coaxial along the longitudinal axis 219 with the cavity 206 of the upper portion 202 extending from the top end 221 to the bottom 227 of the upper portion 202, and the cavity 218 of the lower portion 214 extending from the top 225 of the lower portion 214 to a bottom 217 of the cup 216. The upper portion 202 further includes a brush 208 that is attached to the top of the upper portion 202, and through which shave cream is dispensed for application to a user's face or other body portions to be shaved. When the travel sized shave cream canister is within the space of cavities 206, 218, the nozzle (e.g. 114) of the canister will be engaged against a shoulder 212 of a channel 210 that passes through the top of the upper portion 202 into the base of the brush 208. The shoulder 212 is formed by a stepped reduction in diameter of the channel 210 where the lower portion of the channel (under the shoulder 212) is larger in diameter than the nozzle stem of the shave cream canister, and the upper portion of the channel 210 (above the shoulder 212) is narrower in diameter than the nozzle stem. By pressing the upper portion 202 down toward the lower portion 214, the shoulder 212 presses against the nozzle as the bottom of the canister bears against the bottom 217 of the cup 216, where such motion is along the longitudinal axis 219, as indicated by arrows 223. As a result, the shoulder 212 will bear against the top of the nozzle stem, moving the nozzle stem downward, opening the valve of the canister, and allowing shave cream to leave the canister and pass into the brush 208 though channel 210. A skirt or apron 220 on the top 225 of the lower portion can slide inside the bottom opening at the bottom 227 of the upper portion 202, and have retention features that engage with retention features inside the upper portion 202 to retain the lower portion 214 onto the upper portion 202. The lower portion includes a heat conducting cup 216 which forms the cavity 218. The bottom 217 of the cup 216 can be domed (upwards, peaking at the center) to conform to the bottom of the travel sized shave cream canister and enhance the thermal coupling between the cup 216 and the canister.

A heating element 222 is disposed in thermal contact with the outside of the heat conducting cup 216. The heating element is electrically operated, and can be a resistive heating element. By "thermal contact" it is meant that the heating element is generally in at least physical contact with the outside of the cup 216, although the heating element does not necessarily need to be attached to the cup 216, and thin air gaps can exist without reducing the desired efficacy of heat transfer. A control circuit, which can be provided on a circuit board 224, can operate the heating element 222 by regulating power to the heating element 222, as well as sensing temperature of the heat conducting cup 216 at a specific location. The control circuit can enable power to the heating element 222 for a selected period of time, subject to a temperature limit as sensed by a temperature sensor such as, for example, a thermocouple or thermistor device, as is well known. When the temperature reaches a threshold, the control circuit can open a conduction path to interrupt electric power to the heating element 222 to prevent overheating.

The stand 226 provides a cavity 228 in which the lower portion 214 is received to hold the housing and brush assembly upright. The lower portion 214 can fit loosely, such that the housing can fall into the cavity without requiring any force to overcome friction. The stand includes electrical contacts 232 that mate with corresponding electrical contacts on the bottom of the lower portion 214 of the housing to provide power to the heating element 222. A control circuit 236 can regulate or control power to the electrical contacts according to a time period or an indication that the temperature of the canister has reached a desired temperature. For example, upon pushing an activation button 230 on the stand 226, the control circuit can initiate a timer, and open a circuit to allow electrical current to flow through the electrical contacts 232 to the lower portion 214. If the control circuit 224 in the lower portion 214 interrupts power, such when the heat conducting cup reaches a desired temperature, the voltage change at the electrical contacts 232 can be detected, and the power can be removed from the electrical contacts 232. Likewise, if the timer reaches its maximum time, then the electrical power to the electrical contacts 232 can be shut off. To indicate the status, a light emitting element or other notification means on the stand 226, such as a lit bezel around the button 230, can change from an unlit status to a lit status of a first color (or other on/off notifier), and then to a second color to indicate the shave cream has been sufficiently warmed. To receive electrical power, the stand 226 can have a plug 234 to connect to a power cable.

In operation, the upper and lower portions 202, 214 can be disassembled and a travel sized can of shave cream can be placed into the cavity 206 in the upper portion 202 or into the cavity 218 in the bottom portion 214. Then the lower portion 214 can be assembled back onto the bottom of the upper portion 202, with the bottom of the canister in the cavity 218 of the heat conducting cup 216 of the lower portion 214. The assembled unit of the upper and lower portions 202, 214 can then be placed into the stand 226. Specifically, the lower portion 214 is placed into the cavity 228 of the stand 226. The cavity 228 can include an aligning feature such as a vertical ridge or other interference feature that requires the lower portion 214 to be aligned or oriented to the stand so that the electrical contacts on the bottom of the lower portion 214 align with the electrical contacts 232 on the bottom of the cavity 228 of the stand 226. Once in place in the stand 226, the user can actuate the button 230, which results in electric power being provided to the lower portion 214 from the stand 226 through the electrical contacts. In some embodiments, however, the power can be always on, obviating the need for the user to activate the heating. In embodiments with a button, upon actuating the button 230, a lighting element can be lit to indicate that heating is underway. Once a selected period of time has passed, or when the temperature of the heat conducting cup 216 has reached a threshold temperature, heating is complete, and the lighting element can change color to indicate the shaving cream is now warmed. The upper portion 202 can then be grasped and pushed downward against the lower portion 214 or a button on the bottom of 214 or other actuator can be employed to cause heated shave cream to be emitted from the canister, through the channel 210, and into the brush 208 to be applied to the user's face for shaving.

Figure 3:
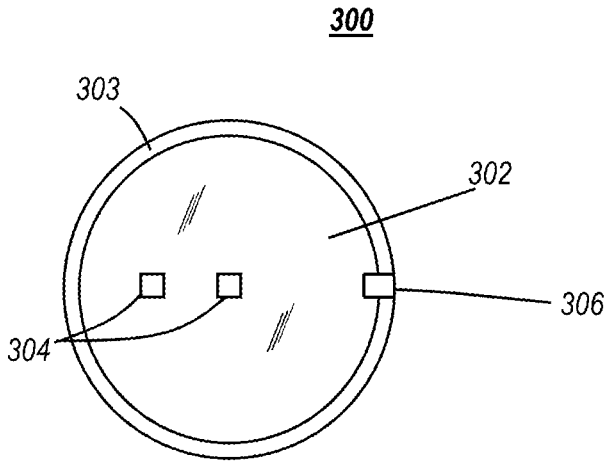
FIG. 3 is a bottom plan view of a heated shave cream brush dispenser, in accordance with some embodiments.

FIG. 3 is a bottom plan view of a heated shave cream brush dispenser 300, in accordance with some embodiments. In particular, the view is of the bottom of a lower portion (e.g. 108 or 214) of the dispenser. A bottom surface 302 can be slightly recessed (e.g. into the page) with respect to a rim 303, and include electrical contacts 304. An aligning feature 306, which can simply be a notch in the rim (outside edge) 303, can be provided to ensure that the electrical contacts 304 align with electrical contacts in the bottom of the stand.

Figure 4:
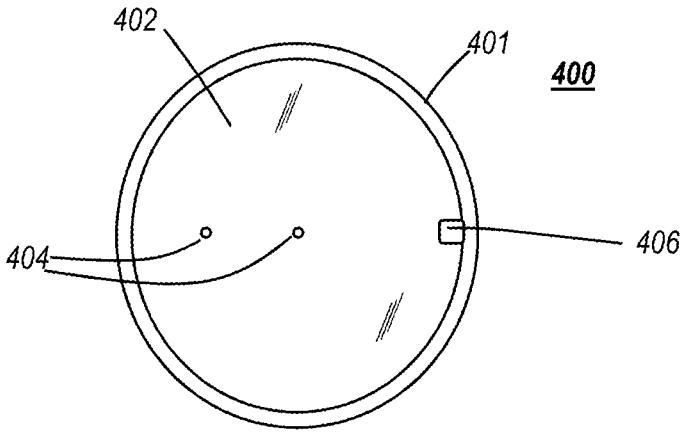
FIG. 4 is an top plan view of a stand for holding, and providing power to a heated shave cream brush dispenser, in accordance with some embodiments.

FIG. 4 is a top plan view of a stand 400 for holding, and providing power to a heated shave cream brush dispenser, in accordance with some embodiments. The stand 400 can be substantially similar to that shown in FIGS. 1 and 2 (e.g. 116, 226) and includes an upright sidewall 401 which defines a cavity 402 that is sized to receive the lower portion of a heated shaving cream dispenser/brush. An aligning feature 406 can be implemented to mate with a corresponding aligning feature (e.g. 306) to ensure that the electrical contacts 404 on the bottom of the cavity 404 are aligned with the electrical contacts (e.g. 304) of the lower portion when the lower portion is properly inserted in the cavity 402 of the stand. Once the lower portion is in place, then the heating process can begin. The aligning feature 406 can be a columnar or raised element that interferes with the rim 303 of the lower portion of the dispenser housing. The height of the aligning feature and be higher than the height of the contacts 404 to prevent any electrical connection until the lower portion of the dispenser is rotated such that the aligning features 306, 406 are in vertical alignment, allowing aligning feature 406 to fit into the channel of aligning feature 306, allowing the dispenser to drop farther down into the stand 400 and complete electrical connection between contacts 304 and contacts 404.

Figure 5:
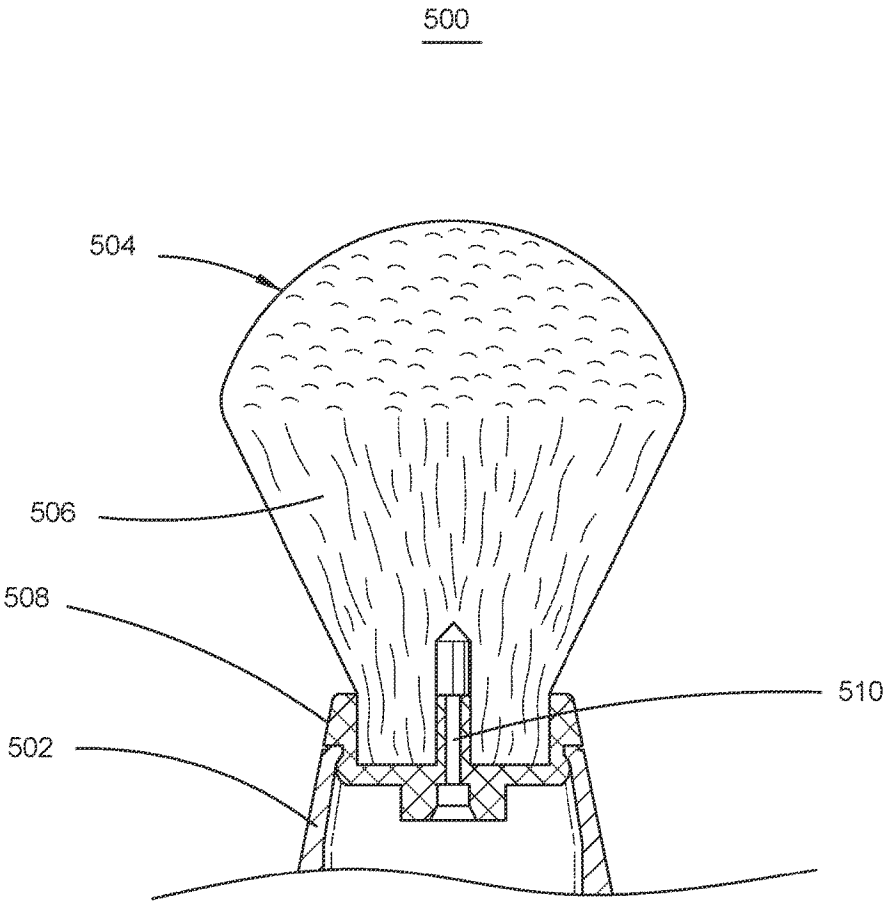
FIG. 5 is a side cut-away view of a top portion of a handle of a heated shave cream dispensing system showing a replaceable brush unit attached thereto, in accordance with some embodiments.

FIG. 5 is a side cut-away view of a top portion of a handle 502 of a heated shave cream dispensing system 500 showing a replaceable brush unit 504 attached thereto, taken through a central longitudinal plane, in accordance with some embodiments. The replaceable brush unit 504 includes bristles 506 gathered together and held by a collar 508 that interfaces with retaining features on the inside of the top portion of the handle 502 to retain the replaceable brush unit 504. The collar 508 further includes a channel 510 through which shaving cream from an aerosol canister can be delivered into the bristles 506, wherein the user can use the bristles 506 to apply the shave cream to their face. The channel 510 includes a shoulder 512, formed as a step, tapering, or other mechanism that can bear against the distal end of a nozzle stem or exit tube of the canister to open the valve of the canister and allow the shave cream to be dispensed by aerosol pressure.

Figure 6:
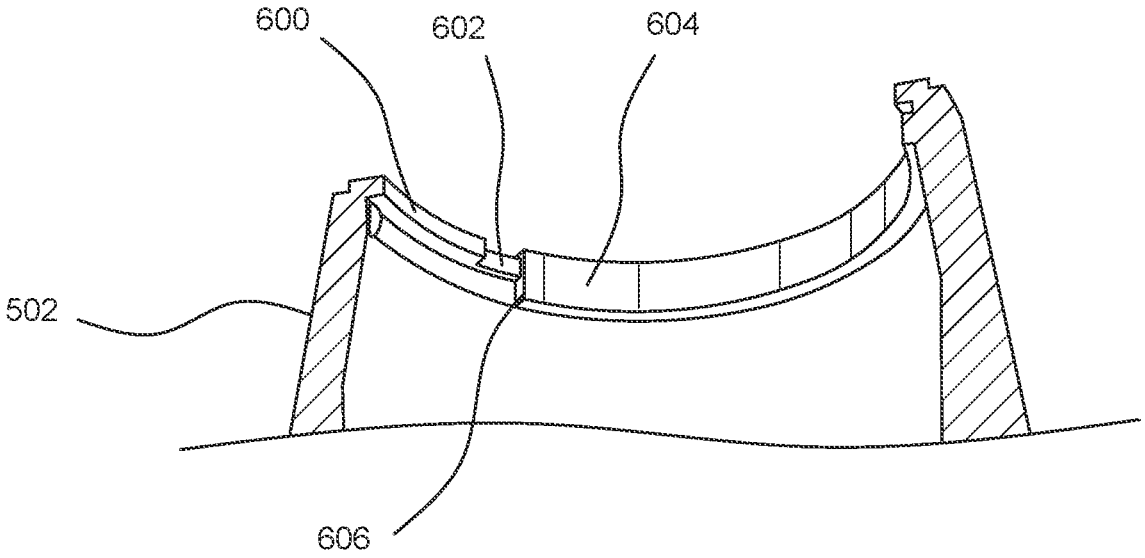
FIG. 6 is a cut-away view of the top portion of the handle in FIG. 5, without the replaceable brush unit present, in accordance with some embodiments.
Figure 7:
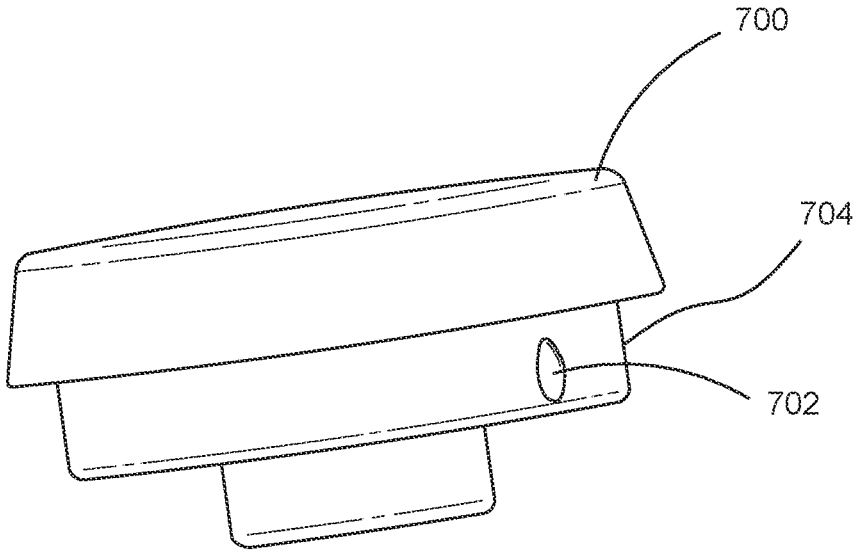
FIG. 7 is a side view of a collar of a replaceable brush unit, in accordance with some embodiments.

FIG. 6 is a cut-away view of the top of an upper portion 502 of a handle in FIG. 5, taken through a central longitudinal plane, without the replaceable brush unit present, in accordance with some embodiments. FIG. 7 shows the collar 508 in more detail, and the collar 508 fits into the top of the upper portion of the handle and holds the bristles. The top of the handle has a circumferential ledge or lip 600 that has a indent 602 to allow an interference protrusion (e.g. 702) on the collar 508 to pass. The mechanical interference between the collar 508 and the lip 600 retains the replaceable brush unit on the handle with or without a grommet. A second lip 604 extends farther down the inside wall of the top portion, and interferes with the protrusion (e.g. 702), preventing the collar 508 from being turned/rotated in that direction. The protrusion 702, however, will clear lip 600, once the collar is seated in the opening of the top portion of the housing, allowing rotation of the collar 508 such that protrusion falls into the indent 602 to create a detent hold. Thus collar 508 must be made of a slightly resilient material.

Figure 8:
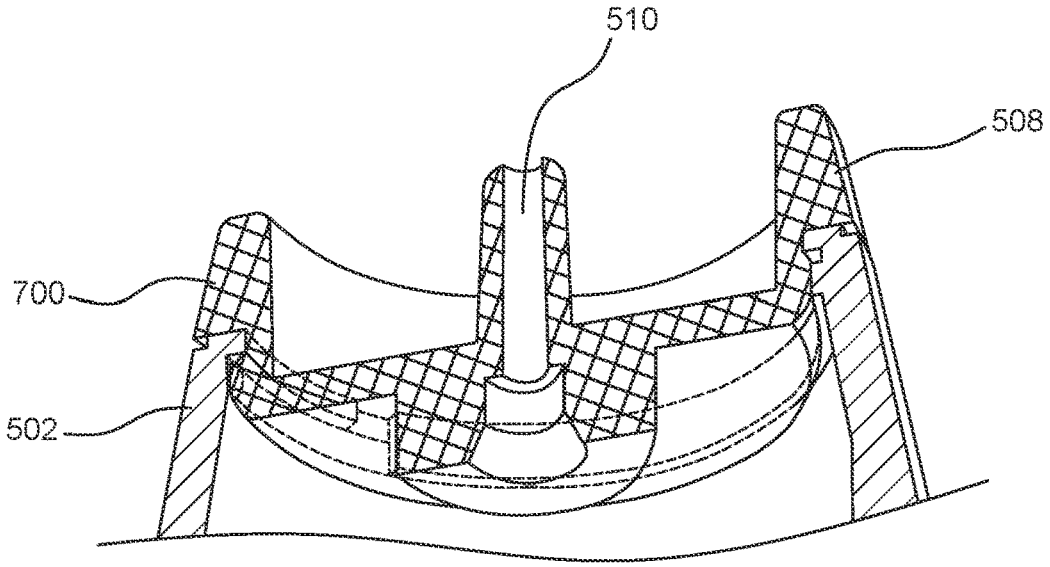
FIG. 8 is a side cut-away view of the top portion of the handle, with the collar of the replaceable brush unit in transparent view, in accordance with some embodiments.

FIG. 7 is a side view of a collar 508 of a replaceable brush unit, in accordance with some embodiments. The collar 508 includes an upper portion 700 that remains outside of the handle of the heated shave cream dispensing system, and a lower portion 704 below the upper portion that fits inside the top portion of the handle. An interference protrusion 702 can pass through the slot 602, allowing the collar to then be rotated/turned, wherein the interference protrusion 702 bear against the underside of the lip 600, thereby retaining the brush unit on the handle with or without a grommet. FIG. 8 is a side cut-away view of the top portion of the handle, taken through a central longitudinal plane, with the collar of the replaceable brush unit in transparent view, in accordance with some embodiments. The center post 800 can be seen extending upward into a space 802 that would be surrounded by bristles (not shown here).

Figure 9:
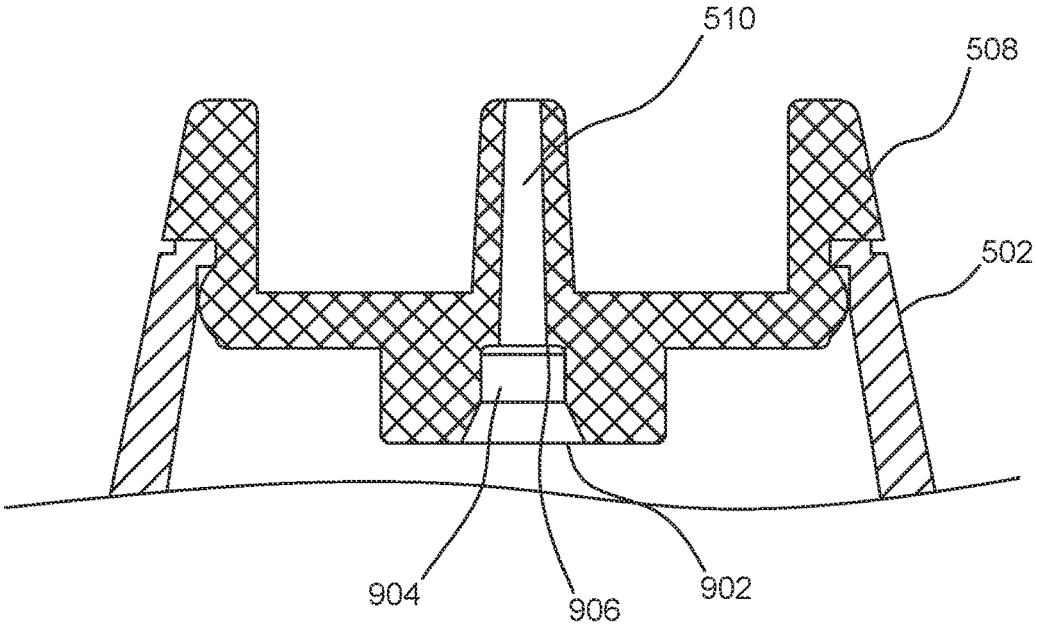
FIG. 9 is a side cut-away view of the replaceable brush unit installed on the handle, and showing the detail of the channel for both actuating the aerosol-propelled shave cream canister, and delivering the shave cream from the canister into the bristles of the brush, in accordance with some embodiments.

FIG. 9 is a side cut-away view of the replaceable brush unit installed on the handle, taken through a central longitudinal plane, and showing the detail of the channel 510 for both actuating the aerosol-propelled shave cream canister, and delivering the shave cream from the canister into the bristles of the brush, in accordance with some embodiments. The channel 510 can be a bore having a diameter that is less than the outside diameter of a shaving cream canister nozzle, and it connects to a bore section 904 that has a slightly larger or equal diameter to that of a shaving cream canister nozzle. A funnel or conic section 902 can facilitate guiding the distal end of the nozzle stem into bore section 904 wherein the top of the nozzle stem can bear against a shoulder 906 at the point where bore 904 meets the channel 510. The shoulder 906 or other mechanism can be used, by relative motion of the handle to the canister or canister to the handle, to press the nozzle tube towards the canister, thereby opening the valve of the canister, and allowing shaving cream to be propelled out of the canister, through channel 510 and into the bristles of the brush and beyond, to the distal tip of the bristles. When the upper portion 502 of the housing is moved downward, the shoulder 906 pushes the nozzle stem towards the canister, opening the valve inside the canister and allowing the shaving cream to be dispensed from the canister, through the nozzle stem, through the channel 900, and into the bristles.

In some embodiments, the design attaches the bristles to a collar that is smaller than the opening in the top of the handle. A secondary collar, as described herein, can be attached as a ring around the bristle collar with the center post 800 through which channel 510 passes going through the predrilled hole in the original bristle collar. The outside collar is intended to be snug with the walls of the handle and have the notch described herein and there may also be a gasket or grommet that is included on or under in order to help make the connection snug and water tight. As shown in FIGS. 8-9, a space 802 is formed as a ring around the center post 800 though which channel 510 passes. The space 802 is bounded in the center by the center post 800 and on the outside by the wall 804 of the collar 508.

A heated shaving cream dispenser has been disclosed that includes two separable portions, an upper portion and a lower portion, in which a travel sized shaving cream canister can be placed. The upper portion also includes a brush and a channel to direct heated shaving cream from the canister into the brush for application to a user's face. Such a brush head may be made to be removable. A stand is used to hold the dispenser while the heating process commences, and ensures that when the dispenser is removed from the stand that no power is applied to the dispenser. The disclosed dispenser provides the benefit of an ergonomically sized dispenser that can be comfortably held while using the brush to apply heated shaving cream to the user's face. The disclosed dispenser also provides the benefit of, by placing the heating element inside the dispenser, having no exposed heated surface, either an exposed heater or an exposed heated can. In some embodiments a charging and heating elements may each be located in the removable handle.

What is claimed is:

1. A shaving cream heating and dispensing device, comprising:

a housing including an upper portion and a lower portion, the upper portion having a cylindrical cavity therein, and the lower portion attached below the upper portion, the lower portion having a cylindrical cavity therein that is contiguous and coaxial with the cylindrical cavity of the upper portion along a longitudinal axis of the device;

the lower portion of the housing including a heat conductive cup having a bottom, and wherein the heat conductive cup forms the cylindrical cavity of the lower portion, and the lower portion further having a heating element embedded therein under the heat conductive cup that is configured to heat the heat conductive cup; and the upper portion including a brush at a top end of the upper portion, a channel formed through the top end to an interior of the top end and having a shoulder at the interior of the top end in the channel;

wherein the cylindrical cavity of the upper portion extends from the top end of the upper portion to a bottom of the upper portion, wherein the cylindrical cavity of the lower portion extends from a top of the lower portion to the bottom of the heat conductive cup, wherein the top of the lower portion is proximate to the bottom of the upper portion, wherein the cylindrical cavities of the upper and lower portions of the housing are configured to hold therein a shaving cream canister having a nozzle and a bottom such that the nozzle is disposed in the channel at the top end of the upper portion and the bottom of the shaving cream canister is in the heat conductive cup of the lower portion of the housing and against a bottom of the heat conductive cup, and wherein the upper and lower portions of the housing are slidably moveable relative to each other along the longitudinal axis upon the upper portion being pressed downward toward the lower portion when the upper and lower portions have been assembled together.

2. A shaving cream heating and dispensing system, comprising:

a housing forming a handle, the housing having an upper portion having a bore through a top end of the upper portion, the housing further having a lower portion, wherein the upper portion and lower portion each have a cylindrical cavity therein, and wherein the cylindrical cavity of the upper portion and the cylindrical cavity of the lower portion are contiguous and coaxial along a longitudinal axis of the housing, wherein the cylindrical cavity of the top portion extends from the top end to a bottom end of the top portion, and the cylindrical cavity of the lower portion extends from a top of the lower portion to a bottom of the lower portion, wherein the top of the lower portion is positioned at the bottom of the upper portion, wherein the upper and lower portions are slidably moveable relative to each other along the longitudinal axis upon the upper portion being pressed downward toward the lower portion when the upper and lower portions are assembled together, a shaving cream aerosol canister housed in the cylindrical cavities of the upper and lower portions of the housing such that a nozzle of the shaving cream aerosol canister is in the bore of the upper portion of the housing and a bottom of the shaving cream aerosol canister is in the cylindrical cavity of the lower portion of the housing and wherein the bottom of the shaving cream aerosol canister bears against the bottom of the lower portion of the housing;

a brush including a set of bristles located on the top end of the top portion of the handle in a collar, a channel formed through a center of the collar, the channel having a shoulder for engaging a nozzle stem of the shaving cream aerosol canister, wherein shaving cream in the shaving cream aerosol canister is dispensed through the channel into the set of bristles upon sliding the top portion axially downward with respect to the shaving cream aerosol canister; and a heating element in the lower portion configured to heat the shaving cream aerosol canister when the shaving cream aerosol canister is inside the handle.

3. A shaving cream heating and dispensing device, holding a shaving cream aerosol canister having a nozzle stem, the device comprising:

a housing including an upper portion and a lower portion, wherein the upper portion and lower portion of the housing each include a cylindrical cavity, wherein the cylindrical cavity of the upper portion and the cylindrical cavity of the lower portion are aligned along a longitudinal axis of the housing and the housing is configured to hold the shaving cream aerosol canister therein with an upper portion of the shaving cream aerosol canister in the cylindrical cavity of the upper portion of the housing and a bottom of the shaving cream aerosol canister in the cylindrical cavity of the lower portion of the housing and wherein the bottom of the shaving cream aerosol canister bears against a bottom of the lower portion of the housing in the cylindrical cavity of the lower portion of the housing, wherein the cylindrical cavity of the upper portion of the housing extends from a top end to a bottom end of the upper portion of the housing, the cylindrical cavity of the lower portion of the housing extends from a top of the lower portion to the bottom of the lower portion of the housing, wherein the top of the lower portion of the housing is positioned at the bottom of the upper portion of the housing, wherein the upper and lower portions are slidably movable relative to each other along the longitudinal axis upon the upper portion being pressed downward toward the lower portion when the upper and lower portions have been assembled together, the upper portion including a brush at the top end, a channel formed from a top of the cylindrical cavity to a set of bristles of the brush, the channel including a shoulder that is configured to bear against a top of the nozzle stem of the shaving cream aerosol canister;

the lower portion of the housing including:

a heat conductive cup surrounding the cylindrical cavity of the lower portion that is configured to receive the bottom of the shaving cream aerosol canister therein in thermal contact with the shaving cream aerosol canister, a heating element configured to heat the cup and a control circuit to control operation of the heating element, and wherein the nozzle stem of the shaving cream aerosol canister biases the top portion of the housing away from the lower portion of the housing as a result of the nozzle stem of the shaving cream aerosol canister bearing against the shoulder in the channel, and the bottom of the shaving cream aerosol canister bearing against the bottom of the heat conductive cup, and wherein the upper and lower portions of the housing are configured to slide relative to each other so as to compress the nozzle stem of the shave cream aerosol canister as the bottom of the shave cream aerosol canister bears against the bottom of the heat conducting cup to thereby dispense shave cream through the channel into the brush.

4. The shaving cream heating and dispensing device of claim 1, further comprising:

a stand having a receiving cup having a space sized to receive the lower portion of the housing therein; and electrical contacts disposed in the receiving cup that are configured to mate with corresponding electrical contacts on the lower portion of the housing.

5. The shaving cream heating and dispensing device of claim 4, wherein the stand further comprises:

an electrical connector configured to connect to an external electric power source; and a switch circuit including a button switch on an external portion of the stand that, when the button switch is activated, provides electric power to the heating element through the electrical contacts.

6. The shaving cream heating and dispensing device of claim 5, wherein the heating element is configured to remain on while the lower portion of the housing is in the stand.

7. The shaving cream heating and dispensing device of claim 1, wherein the lower portion of the housing has a skirt at the top of the lower portion which slides longitudinally inside the bottom opening at the bottom of the upper portion of the housing upon the upper portion the lower portions being pressed together along the longitudinal axis.

8. The shaving cream heating and dispensing device of claim 1, wherein the brush is replaceable and can be removed from the top end of the upper portion.

9. The system of claim 2, wherein the brush is replaceable.

10. The system of claim 9, wherein the replaceable brush comprises a lower portion of the replaceable brush having a collar that fits into a top opening of the top end the upper portion of the handle and includes a retaining feature that engages a corresponding retaining feature of the upper portion of the handle to retain the brush on the top end of the handle.

11. The system of claim 10, wherein the retaining feature on the lower portion of the replaceable brush is a detent protrusion.

12. The system of claim 11, wherein the top portion of the handle, at an inside of the top opening of the top portion of the handle, includes a first lip and a second lip with a channel formed longitudinally therebetween that is sized to allow the detent protrusion to pass longitudinally upon inserting the replaceable brush into the top opening of the handle, and wherein the second lip extends farther down than the first lip and prevents the detent protrusion from passing in a direction of the second lip, and wherein the first lip is sized to allow the detent protrusion to pass under it upon the replaceable brush being rotated such that the detent protrusion moves in a direction of the first lip from the channel to between the first and second lips.

13. The system of claim 2, wherein the channel includes a conic opening at a bottom of the channel.

14. The system of claim 2, wherein the heating element is configured to remain on while the shaving cream aerosol canister is present in the handle.

15. The system of claim 2, wherein the heating element is configured to operate in response to a manual actuation of a button or other actuator on the handle.

16. The system of claim 2, wherein the lower portion of the housing includes a skirt at a top of the lower portion which extends into the bottom end of the upper portion to slide longitudinally within the upper portion upon the upper portion being pressed toward the lower portion.

17. The shaving cream heating and dispensing device of claim 3, further comprising a stand, wherein the lower portion of the housing includes a pair of electrical contacts that electrically interface with corresponding electrical contacts in the stand, wherein the stand is configured to hold the handle in an upright vertical position.

18. The shaving cream heating and dispensing device of claim 3, wherein the brush is replaceable.

* * * * *